United States Patent [19]

Cuschera

[11] 4,339,832

[45] Jul. 20, 1982

[54] FLUSH MOUNTED POP UP DRAIN FITTING

[76] Inventor: Casper Cuschera, 800 Durham Rd., Fremont, Calif. 94538

[21] Appl. No.: 143,791

[22] Filed: Apr. 25, 1980

[51] Int. Cl.[3] ..... A47K 1/14; E03C 1/26

[52] U.S. Cl. ..... 4/287; 4/286; 4/295

[58] Field of Search ..... 4/286, 287, 288, 290–292, 4/293, 295

[56] References Cited

U.S. PATENT DOCUMENTS

| | | | |
|---|---|---|---|
| 3,366,980 | 2/1980 | Petursson et al. | 4/295 |
| 3,380,081 | 4/1968 | Eilertson et al. | 4/295 |
| 3,428,295 | 2/1969 | Downey et al. | 4/295 X |
| 3,465,372 | 9/1969 | Reagan | 4/295 X |
| 3,771,177 | 11/1973 | Rogers | 4/287 |
| 4,007,500 | 2/1977 | Thompson et al. | 4/295 |
| 4,103,372 | 8/1978 | Cuschera | 4/295 X |
| 4,144,599 | 3/1979 | Cuschera | 4/295 X |
| 4,188,676 | 2/1980 | Tolnai | 4/295 |

*Primary Examiner*—Henry K. Artis

*Attorney, Agent, or Firm*—Harris Zimmerman; Howard Cohen

[57] ABSTRACT

A flush mounted, pop-up drain fitting includes a shallow, hollow cylindrical drain body having a flange extending radially outwardly from the upper end thereof and adapted for flush mounting with a tub or basin surface. A plurality of arms extend downwardly from the lower end of the drain body, the arms extending obliquely inwardly toward the axis of the drain body. The lower, distal ends of the arms are joined to a lower cylindrical member which is provided with an axially disposed threaded hole. A pop-up drain mechanism is secured in the threaded hole, and is positioned to form a seal with an annular lip in the lower end of the drain body. In the sealed or closed position, the pop-up drain fitting is substantially flush with the upper surface of the flange.

6 Claims, 4 Drawing Figures

FLUSH MOUNTED POP UP DRAIN FITTING

BACKGROUND OF THE INVENTION

The following U.S. Pat. Nos. exemplify the state of the art of selectively self-sealing drain valves: 4,103,372, 3,771,177, 3,428,295, 3,380,081, 3,366,980, 2,173,529.

It is well known in the prior art to provide sealable drain valves in large plumbing installations such as bathtubs, roman tubs, and the like. Because of the size of these fixtures, it is often difficult to install self-sealing drains having a remote actuator which is linked to the drain itself via a lever or chain arrangement extending beneath the tub. The most popular form of sealable drain valve which does not require a remote actuator is a pop-up drain fitting, such as the one shown in U.S. Pat. No. 4,144,599, issued Mar. 20, 1979, to Casper Cushera. However, pop-up drain fittings are not suitable to large tub installations such as roman tubs, due to the fact that the drain is often placed in a central portion of the bottom of the tub, in a position where the bather is likely to sit or recline. All prior art pop-up drain fittings are constructed so that the drain sealing cover extends substantially above the plane of the tub surface in which the drain fitting is secured. As a result, the drain cover may interfere with the bather in the tub, and might easily cause injury to the bather. Also, the drain sealing cover of a pop-up drain fitting is often released from the sealed position by the application of slight force to one side of the drain cover. There is a great likelihood that a pop-up drain fitting as known in the prior art often would be inadvertently released and opened by a bather sitting or reclining on or near the pop-up drain fitting.

SUMMARY OF THE PRESENT INVENTION

The present invention generally comprises a pop-up drain fitting adapted for use in a large tub or similar installation, and designed to eliminate interference with a bather using the tub. More specifically, the resealable drain fitting of the present invention is designed so that the drain sealing cover thereof is disposed flush with the bottom surface of the tub in which the drain is installed, when the drain sealing cover is in the sealed position.

The invention includes a generally cylindrical drain body having a drain bore extending therethrough, with a flange extending radially outwardly from the upper extent thereof. An interior lip extends radially inwardly in the drain bore from the lower end of the drain body.

A plurality of support arms extend downwardly from the lower surface of the lip, and converge to join an axially disposed web portion. A threaded hole is disposed in the web portion in axial fashion, and the post of a pop-up drain fitting is secured in the threaded hole. The sealing gasket of the pop-up drain fitting is adapted to impinge upon the lip of the drain body under urging of a drain cover disposed superjacently thereof. In the sealed position, the upper extent of the drain cover is substantially flush with the flange extending from the drain body.

DESCRIPTION OF THE PREFERRED EMBODIMENT

Figure 1:
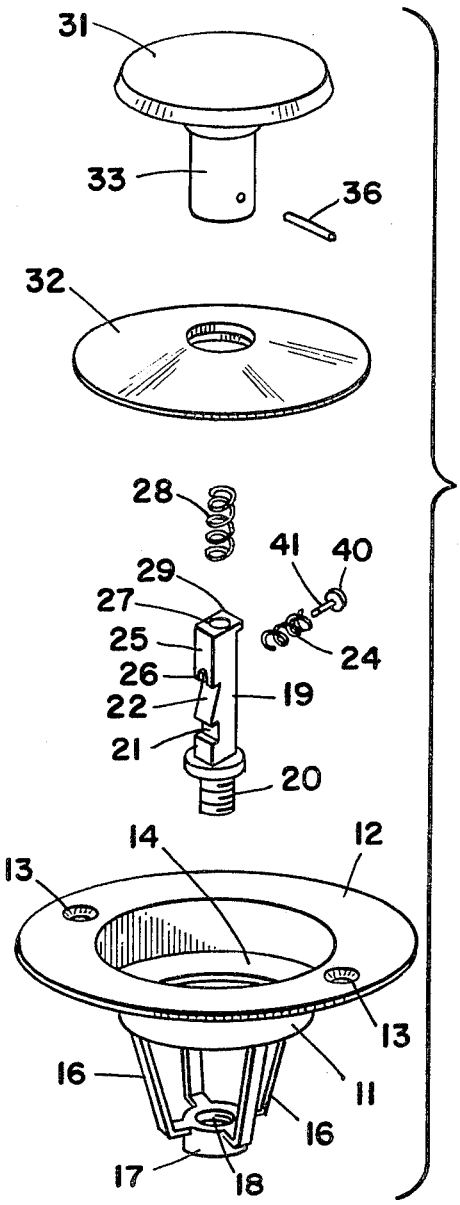
FIG. 1 is an exploded view of the drain fitting of the present invention.

With reference to the accompanying figures, the preferred embodiment of the drain fitting of the present invention includes a drain body 11 having a generally cylindrical configuration and including a bore extending axially therethrough. A flange 12 extends radially outwardly from the upper extent of the drain body 11, and includes a pair of diametrically opposed, countersunk holes 13 for securing the drain body in the drain opening of a tub, basin, or the like. A lip 14 extends radially inwardly into the bore of the drain body from the lower end thereof.

A plurality of support arms 16 extend obliquely downwardly from the lower surface of the lip 14, and converge to join a medial web portion 17. A threaded hole 18 extends through the medial web portion 17, and is aligned axially with the bore of the drain body. In the preferred embodiment four support arms 16 are employed, although it may be appreciated that the number of support arms is not significant.

Figure 4:
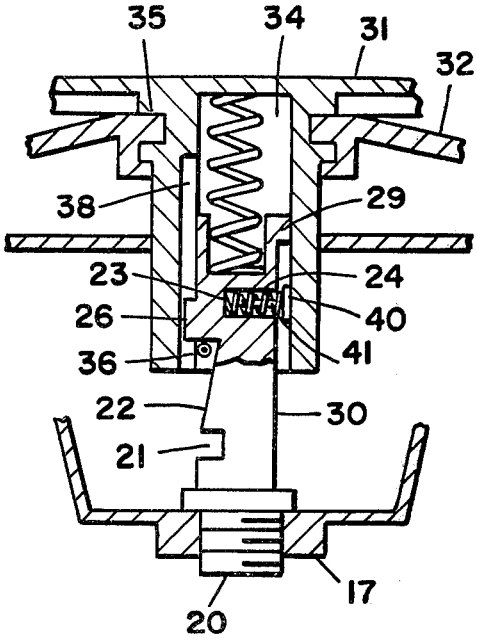
FIG. 4 is an enlarged, vertical cross-sectional view of the drain fitting of the present invention.
Figure 2:
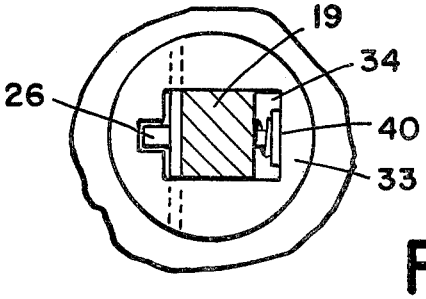
FIG. 2 is an enlarged, horizontal cross-sectional view of the post assembly of the drain fitting.

The drain of the present invention also includes a generally rectangular post 19 which is provided with a lower threaded end 20 adapted to be secured in the threaded hole 18 of the drain body. One vertical surface 25 of the rectangular post 19 is provided with a laterally extending detent slot 21. The same vertical surface is also provided with a ramped camming surface 22 extending from the upper lip of the slot 21 upwardly and obliquely inwardly, as shown in FIGS. 1 and 4. The vertical surface 25 is also provided with a knob 26 extending radially outwardly therefrom directly above the upper extent of the camming surface 22.

Figure 3:
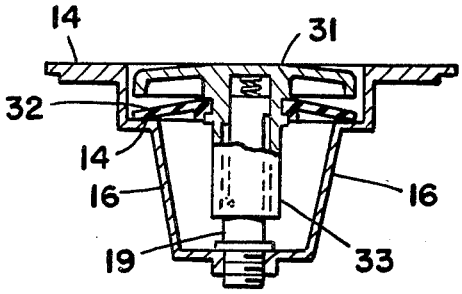
FIG. 3 is a vertical cross-sectional view of the drain fitting of the present invention, shown in the sealed position.

The vertical surface 30 of the rectangular post, which is opposed to the vertical surface 25, is provided with a radially extending hole 23, as shown in FIG. 4. Disposed in the hole 23 is a helical compression spring 24, and a flat head biasing member 40 having a short shank 41 extending inwardly therefrom and through the spring 24. The spring 24 biases the member 40 radially outwardly, for reasons which will be explained in the following description. Extending from the upper end of surface 30 is a lip 29. As shown in FIGS. 1, 3, and 4, the lip 29 extends laterally outwardly only from the surface 30. Disposed in the top of the rectangular post 19 is a center bore 27. Seated in the bore 27 is a helical compression spring 28, which extends upwardly from the rectangular post. The function of the spring 28 will be made apparent in the following description.

The drain valve of the present invention also includes a generally disk-like, rigid drain cover 31. Extending downwardly from the drain cover and disposed concentric with the axis thereof is a tubular member 33. The tubular member 33 is provided with a reduced diameter annulus 35, as shown in FIG. 4, and an annular sealing gasket 32 is resiliently secured in the annulus 35 with the peripheral portion of the gasket angled slightly downwardly with respect to the cover 31. The outer diameter of the gasket 32 is less than the diameter of the bore of the drain body, and greater than the lip 14 of the drain body. The peripheral edge of the gasket 32 is adapted to impinge on the lip 14 in sealing fashion to prevent any liquid flow through the bore of the drain body.

With reference to FIG. 4, the tubular member 33 includes a hollow bore 34 extending axially therein and adapted to receive the rectangular post 19. The width of the post from side 25 to side 30 is less than the diameter of the bore 34, and the tubular portion 33 is disposed parallel to the post 19 and laterally offset therefrom. The lip 29 extending from the side 30 of the post maintains the lateral offset of the tubular portion 33, and the spring biased member 40 maintains the tubular portion in parallel alignment with the post 19. It may be appreciated, however, that the cover member 31 may be rocked or pivotted about the lip 29, the member 40 being urged against the spring force of spring 24 into the hole 23. The bore 34 also includes a groove 38 extending parallel to the axis thereof and adapted to receive the knob 26 in sliding fashion. The engagement of the knob 26 in the groove 38 prevents any relative rotation of the post 19 and the cover 31.

A latch pin 36 is also provided in the lower end of the tubular member 33, extending along a cord through the bore 34. The latch pin 36 is disposed adjacent to the camming surface 22, and is adapted to be retained in the detent slot 21.

It may be understood that the compression of the spring 28 biases the cover 31 upwardly, so that the gasket 32 clears the lip 14 of the drain body by a substantial margin. In this configuration, shown in FIG. 4, there is free outflow through the gap defined by the gasket 32 and the lip 14.

To close the drain valve and prevent fluid flow through the bore, the cover member is manually urged downwardly by pressure applied directly above the tubular member 33 or to a portion of the cover along a radius thereof opposed to lip 29. As the cover is depressed, the latch pin 36 rides the camming surface 22, causing the tubular member 33 to pivot slightly about the lip 29 and urge the member 40 into its hole 23. As the latch pin 36 reaches the detent slot 21, the resilient urging of the spring 24 causes the latch pin to enter the slot 21, locking the cover in the depressed position. The cover 31 forces the gasket 32 against the lip 14 within the drain body, effecting a seal therewith. It may be appreciated that any pressure loading due to liquid accumulating above the drain will merely increase the sealing action of the gasket 32.

To release the drain valve from the closed, depressed position shown in FIG. 3, the cover member is again depressed in the general area along a radii parallel with the lip 29. This action urges the member 40 into the hole 23, and releases the latch pin 36 from the slot 21. The expansive force of the spring 28 then urges the cover member upwardly, opening the valve and allowing flow therethrough. The upward travel of the cover member is limited by the upper extent of the surface 22.

With reference to FIG. 3, it may be noted that in the depressed and sealed position, the cover member 31 is substantially flush with the flange 12 and with the bottom surface of the tub in which the drain is situated. Thus a bather may sit or recline directly over the area in which the drain of the present invention is installed, without injury or discomfort. Furthermore, the flush disposition of the cover 31 minimizes the likelihood of the drain being opened accidentally by casual application of weight upon the cover 31.

I claim:

1. In a drain valve including a drain body having a flow channel therethrough and a post extending axially through said flow channel, and a drain sealing cover provided with a tubular portion having a central passage receiving said post for slidable translation thereabout and radial clearance therefrom, said drain sealing cover being translatable from a first upper position to a second lower position, detent means in said post for selectively securing said post and said tubular portion with said drain sealing cover in said second position, the improvement comprising an annular lip extending radially inwardly in said flow channel and disposed at the lower end of said drain body, said drain sealing cover impinging on said lip when in said second position to effect a seal of said flow channel, the uppermost extent of said drain sealing cover extending substantially flush with the upper end of said drain body when in said second position.

2. The drain valve of claim 1, further including a plurality of support arms extending downwardly from said drain body and converging toward the axis thereof.

3. The drain valve of claim 2, further including a medial web portion joined to the lower ends of said support arms, said web portion including means to support said post.

4. The drain valve of claim 1, further including a flange extending radially outwardly from said upper extent of said drain body.

5. The drain valve of claim 1, wherein said drain sealing cover includes an annular gasket adapted to impinge on said lip in sealing fashion.

6. The drain valve of claim 2, wherein said lip is disposed in the lower end of said drain body adjacent to the upper ends of said support arms.

* * * * *